United States Patent [19]

Bar-Kokhba

[11] Patent Number: 4,634,013

[45] Date of Patent: Jan. 6, 1987

[54] CLOSING AND OPENING DEVICE FOR MEMBRANE-SEALED BOTTLES

[76] Inventor: Abraham Bar-Kokhba, 67 Prospect Ave., Hewlett, N.Y. 11557

[21] Appl. No.: 741,764

[22] Filed: Jun. 6, 1985

[51] Int. Cl.[4] ..... B65D 41/50

[52] U.S. Cl. ..... 215/228; 215/257; 222/83

[58] Field of Search ..... 215/228, 226, 297, 257; 222/81, 83

[56] References Cited

U.S. PATENT DOCUMENTS 1,100,433 6/1914 Johnson ..... 222/81

3,182,858 5/1965 Beaudoin ..... 222/83

FOREIGN PATENT DOCUMENTS 2153446 5/1973 Fed. Rep. of Germany ..... 215/257

*Primary Examiner*—Donald F. Norton

*Attorney, Agent, or Firm*—Jordan and Hamburg

[57] ABSTRACT

A closing and opening device for a bottle with an opening sealed by a membrane comprises a cap adapted to engage the opening of the bottle for closing the same, a cutting device for cutting the membrane of the bottle connected to the cap, and a device to allow rotation of the cap less than 360 degrees relative to the opening of the bottle while the cutting device is in engagement with the membrane, so that the membrane is cut less than 360 degrees to prevent the membrane being cut from detaching from the bottle.

11 Claims, 7 Drawing Figures

CLOSING AND OPENING DEVICE FOR MEMBRANE-SEALED BOTTLES

FIELD OF THE INVENTION AND RELATED ART STATEMENT

The present invention relates to a closing and opening device for a bottle sealed by a membrane, more particularly a cap to be used for closing a bottle and having a blade for cutting a membrane of the bottle.

Liquid and powdered materials are frequently held in plastic bottles for convenience and safety. In order to prevent undetectable tampering with the contents of the plastic bottles, the plastic bottles are sealed by membranes. Therefore, when the bottles are opened, the membranes must be broken or torn out by means of a blade and be removed from the bottle. Otherwise, the membrane left around an opening of a bottle prevents materials in the bottle from flowing out of the bottle smoothly.

In U.S. Pat. No. 3,182,858, a punching stopper for a bottle is provided with a cap having a perforator, and a spacer detachably connected to the cap. The cap with the spacer can be tightly connected to an opening of a bottle without breaking a seal. However, when the seal on the opening is broken, the spacer is removed from the cap, and the cap is screwed onto the opening. Consequently, the spacer is torn by the perforator. Since the seal broken by the perforator is pushed inside the opening, when material in the bottle is poured by tilting the bottle, material flowing through the opening pushes the seal to thereby block smooth flow of the material. Therefore, the punching stopper is not quite practical.

In U.S. Pat. No. 3,581,605, an opening device is designed to cut and remove a seal at an opening of a bottle. The device is located on the opening and is pushed over the seal, so that an extracting member engages the seal and then an annular cuting member cuts the seal completely. When the device is detached from the bottle, the seal is removed from the bottle as well. The device is useful to remove the seal, but the device can not be used to close the opening of the bottle.

Accordingly, an object of the present invention is to provide a closing and opening device for a membrane-sealed bottle, in which inconveniences of the prior art devices are obviated.

Another object of the invention is to provide a device as stated above, which can be used to close and open an opening of a bottle and can cut a membrane sealed over the opening without blocking a smooth flow of material passing therethrough.

A further object of the invention is to provide a device as stated above, in which a membrane cut by the device does not fall inside the bottle and can be completely removed from the bottle.

A still further object of the invention is to provide a device as stated above, which can be easily and economically manufactured.

Further objects and advantages of the invention will be apparent from the following description of the invention.

SUMMARY OF THE INVENTION

In accordance with the present invention, a closing and opening device can be used to cut a membrane attached over an opening of a bottle and is detachably fastened to the opening. The closing and opening device of the invention comprises a cap adapted to engage the opening of the bottle for closing, means connected to the cap, for cutting the membrane of the bottle, and means for allowing rotation of the cap less than 360 degrees relative to the opening of the bottle. The means for allowing rotation is connected to the cap so that while the cap is rotating, the membrane of the bottle is cut less than 360 degrees to thereby prevent the membrane being cut from detaching from the bottle.

Consequently, the membrane cut by the cutting means does not fall inside the bottle, and when the bottle is tilted to pour material from the bottle, the membrane is forced to move outside the bottle to thereby prevent blockage of the flow of material. Thereafter, if necessary, the membrane can be completely detached from the bottle by simply pulling the membrane.

The cap comprises a head, a first circular wall integrally connected to the head, and a first female thread formed at the inner periphery of the first circular wall. The cap can be attached to and detached from the opening of the bottle.

In the first embodiment, the means for allowing rotation of the cap comprises a second circular wall connected to the cap to define a mouth therearound and extending from the head in the direction opposite to the first circular wall. A second female thread is formed at the inner periphery of the second circular wall to extend less than 360 degrees. Therefore, when the second female thread is engaged with a male thread of a bottle, the second circular wall can not turn one complete rotation.

The cutting means is formed inside the second circular wall to extend from the head to the mouth thereof. Therefore when the second female thread is engaged and rotated relative to the male thread of the bottle, the membrane of the bottle is cut circularly less than 360 degrees.

In another embodiment, the means for allowing rotation of the cap comprises a collar integrally and detachably connected to an end of the first circular wall. The cutting means is, in this case, formed inside the first circular wall to extend from the head. When the cap with the collar is tightened onto the opening of the bottle, the cutting means is located above the membrane to thereby completely close the opening without cutting the membrane. When the collar is removed from the cap, the cap can be further turned within a range less than 360 degrees. The membrane on the opening can be cut by the cutting means.

In another embodiment, the means for allowing rotation of the cap comprises a collar integrally and detachably connected to an end of the first circular wall. The cutting means is, in this case, formed inside the first circular wall to extend from the head. When the cap with the collar is tightened onto the opening of the bottle, the cutting means is located above the membrane to thereby completely close the opening without cutting the membrane. When the collar is removed from the cap, the cap can be further turned within a range less than 360 degrees. The membrane on the opening can be cut by the cutting means.

DETAILED DESCRIPTION OF PREFERRED EMBODIMENTS

Figure 1:
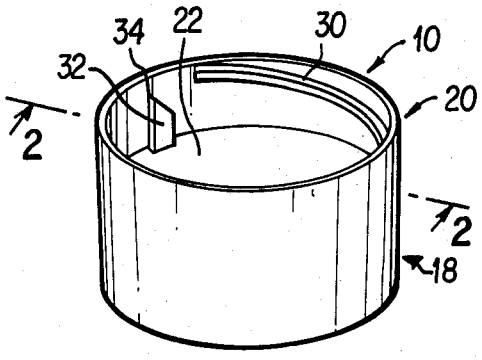
FIG. 1 is an enlarged perspective view of a closing and opening device of the present invention.
Figure 2:
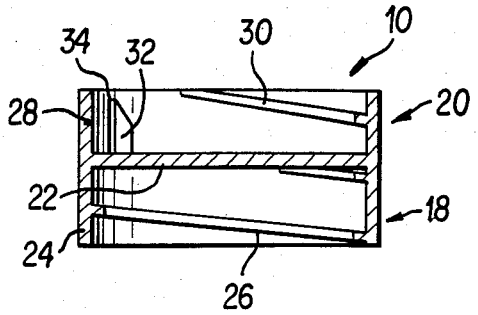
FIG. 2 is a section view taken along line 2—2 of FIG. 1.
Figure 3:
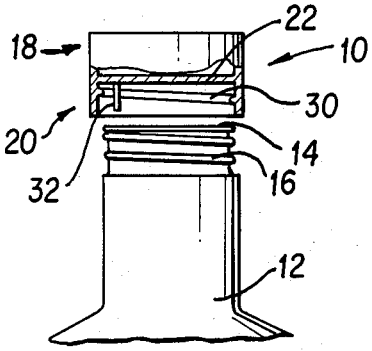
FIG. 3 is a side view of a bottle and a closing and opening device, the device being illustrated partly in section.

Referring to FIGS. 1–3, a first embodiment of a closing and opening device 10 of the present invention is illustrated. The device 10 is designed to engage a bottle 12 having an opening sealed by a membrane 14 and a thread 16 around the opening.

As clearly shown in FIG. 2, the device 10 comprises a cap section 18 to be used for closing the opening of the bottle 12, and a cutting section 20 to be used for cutting the membrane 14 of the bottle 12. The cap section 18 is provided with a head 22, a circular wall 24 integrally connected to the head 22, and a thread 26 formed inside the wall 24. The thread 26 can be engaged with the thread 16 of the bottle 12. Namely, the cap section 18 is attached to and detached from the bottle 12 when opening and closing the bottle 12.

The cutting section 20 of the device 10 is provided with a circular wall 28 integrally formed with the head 22 and the circular wall 24, and a thread 30 formed inside the wall 28. The thread 30 is circularly arranged from a top of the wall 28 to the head 22 along the wall 28 to an extent of less than 360 degrees, and is engageable with the thread 16 of the bottle 12. Therefore, when the cutting section 20 is engaged with the opening of the bottle 12, the cutting section 20 can be turned less than one complete rotation.

The cutting section 20 is further provided with a blade 32 extending outwardly from the head 22. The blade 32 includes an upper point 34, the height of which is less than that of the wall 28. Therefore, even if some material is placed on the cutting section, the material as well as the point 34 are not damaged.

When the bottle 12 is sold, the cap section 18 of the device 10 is screwed onto the opening of the bottle 12, so that the opening and the membrane 14 are protected by the device 10. When the bottle 12 is opened, the device 10 is removed from the the bottle 12. Thereafter, the device 10 is inverted so that the cutting section 20 is pointed toward the opening of the bottle 12. Then, the device 10 is engaged with the bottle 12 and is turned until the device 10 is stopped, which is less than one complete rotation. Consequently, the membrane 14 is substantially (not completely) cut by the blade 32. The device 10 is, thereafter, unscrewed to remove the device from the bottle 12.

In this situation, the membrane 14 substantially cut by the blade 32 does not fall into the bottle 12. When the bottle 12 is tilted, material in the bottle 12 is poured outwardly. In this case, the membrane 14 partly attached to the bottle 12 is forced outwardly by the material flowing through the opening of the bottle 12. The membrane 14 does not block smooth flow of the material. The membrane 14 partly cut by the blade may be left as it is, but, if necessary, the membrane 14 can be completely removed from the bottle by simply pulling the membrane 14 by means of one's fingers. When the bottle is closed, the cap section 18 of the device 10 is screwed onto the opening of the bottle 12. In this invention, the membrane 14 cut by the blade 32 neither falls inside nor outside the bottle 12 nor blocks smooth flow of material from the bottle 12.

Figure 4:
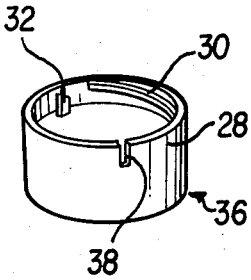
FIG. 4 is a perspective view of a closing and opening device having a slit therein.

A closing and opening device 36 as shown in FIG. 4 is the same as the closing and opening device 10 explained before. However, the device 36 is provided with a slit 38 on the circular wall 28. The slit 38 operates to have liquid in the circular wall 28 flow outwardly therethrough. Consequently, even if the bottle 12 is stored outdoors, liquid does not accumulate in the cutting section 20.

Figure 5:
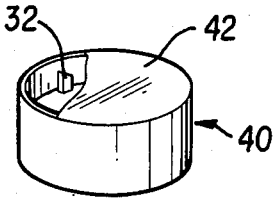
FIG. 5 is a perspective view of a closing and opening device having a cover thereon.

A closing and opening device 40 as shown in FIG. 5 is the same as the closing and opening device 10 as explained before. The device 40 is, however, provided with a cover 42 attached to the circular wall 28 to enclose the cutting section 20. The cover 42 prevents any material from accumulating in the cutting section 20, while the bottle is stored. When the cutting section 20 is used, the cover 42 is broken, so that the device 40 can be utilized as usual.

Figure 6:
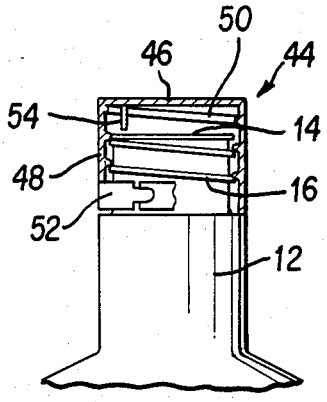
FIG. 6 is a side view of another embodiment of a closing and opening device of the invention, the device being illustrated partly in section.

Another embodiment of a closing and opening device 44 is disclosed in FIG. 6, wherein the cap section 18 and the cutting section 20 as shown in the other embodiments are combined. Namely, the device 44 is provided with a head 46, a circular wall 48 integrally connected to the head 46, and a thread 50 formed inside the wall 48. The device 44 is further provided with a collar 52 integrally and detachably connected to the wall 48. A blade 54 is connected to the head 46 to orient toward the collar 52.

When the bottle 12 is manufactured and sold, the device 44 with the collar 52 is screwed onto the opening of the bottle, so that the thread 50 firmly engages the thread 16 of the bottle 12, and the blade 54 is above the membrane 14, with the threads 50 and 16, but for the presence of the collar 52, permitting the device 44 to be rotated further, first into initial engagement with the membrane 14 and, thereafter, less than an additional 360 degrees. When the bottle 12 is to be opened, the collar 52 is removed from the wall 48 by pulling the same. As a result, the device 44 can be screwed further onto the bottle 12 until the blade 54 first engages the membrane 14 and then rotate less than 360 degrees, thereby cutting a substantial circular arc of less than 360 degrees through the membrane 14. Of course, the blade 54 may initially be slightly above the membrane 14 that initial engagement of the blade 54 with the membrane 14 occurs within the first few degrees of further turning of the device 44 after the collar 52 is removed. Thereafter, the device 44 is removed from the bottle 12, so that when the bottle 12 is tilted, material inside the bottle 12 is poured outwardly. The membrane 14 cut by the blade 54 neither falls inside our outside the bottle 21 nor blocks the smooth flow of material from the bottle 12. If required, the opening or the bottle can be completely closed by the device 44.

In the embodiments as explained above, the blades 32, 54 are made of thin strips with points, so that when the device is operated, the point, at first, engages and cuts the membrane. Thereafter, the cutting edge of the blade cuts the membrane circularly. In this example, since the blade is thin, the cutting width of the blade is very narrow.

Figure 7:
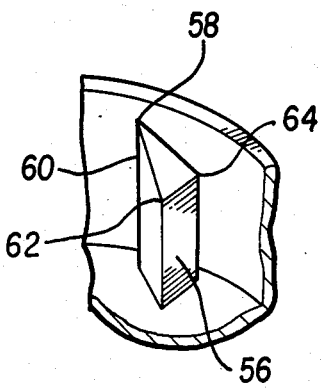
FIG. 7 is an enlarged perspective view of a blade to be used in the present invention.

FIG. 7 shows a new blade 56 different from the blades 32, 54. The blade 56 can be employed in the embodiments as explained before instead of the blades 32, 54. The blade 56 is a triangular column shape and includes points 58, 62, 64 and a cutting edge 60. When the device with the blade 56 is used, the membrane 14 is, at first, pierced by the point 58 and is cut by the cutting edge 60. Since the blade 56 has the point 62 closer to the center of the bottle than the point 64, the membrane 14 cut by the blade 56 is pushed toward the center of the opening of the bottle, so that a relatively wide cutting width is formed. Therefore, after the device is removed from the bottle, if desired, the membrane substantially cut by the blade 56 can be nipped by fingers and removed from the bottle. The blade 56 is especially suitable when the membrane is removed from the bottle after cutting by the device.

In all embodiments of the invention, the minimum arc to be cut through the membrane is not critical but, generally, it is preferred that the arc be greater than 180 degrees so that the contents of the bottle will pour reasonably freely without one having to manually peel or tear away the membrane after it has been cut.

While the invention has been explained with reference to the specific embodiments of the invention, the explanation is illustrative and the invention is limited only by the appended claims.

What is claimed is:

1. A closing and opening device for a bottle with an opening sealed by a membrane, comprising:

a cap adapted to engage the opening of the bottle for closing the same, means for cutting the membrane of the bottle without pushing the membrane downwardly while cutting, said cutting means being connected to the cap, and means for allowing rotation of the cap less than 360 degrees relative to the opening of the bottle, said means for allowing rotation being connected to the cap so that while the cap is rotating, the membrane of the bottle is cut less than 360 degrees without pushing the membrane downwardly to prevent the membrane being cut from detaching from and entering into the bottle.

2. A closing and opening device according to claim 1, in which said cap comprises a head, a first circular wall integrally connected to the head, and a first female thread formed at the inner periphery of the first circular wall adapted to engage a male thread of the bottle.

3. A closing and opening device according to claim 2, in which said means for allowing rotation of the cap comprises a collar integrally and detachably connected to the end of the first circular wall opposite the head of the cap, said collar being adopted to be detached from the first circular wall when the bottle is opened.

4. A closing and opening device according to claim 3, in which said cutting means is formed inside the first circular wall to extend from the head, said cutting means being located above the membrane when the cap with the collar is tightened onto the opening of the bottle, said cutting means, when the collar is removed from the cap, being further rotatable less than 360 degrees to thereby engage and cut the membrane.

5. A closing and opening device according to claim 4, in which said cutting means is in the shape of a triangular column having a cutting edge and first, second and third corners, said first corner being located on the cutting edge and extending outwardly further than the second and third corners and the second corner being located close to a center of the first circular wall so that the membrane cut by the cutting means is pushed toward the center of the opening of the bottle.

6. A closing and opening device for a bottle with an opening sealed by a membrane, comprising:

a cap adapted to engage the opening of the bottle for closing the same, said cap including a head, a first circular wall integrally connected to the head, and a first female thread formed at the inner periphery of the first circular wall adapted to engage a male thread of the bottle, means for cutting the membrane of the bottle, said cutting means being connected to the cap, and means for allowing rotation of the cap less than 360 degrees relative to the opening of the bottle, said means for allowing rotation including a second circular wall connected to the cap to define a mouth therearound and extending from the head in the direction opposite to the first circular wall, and a second female thread formed at the inner periphery of the second circular wall to extend less than 360 degrees so that when the second female thread is engaged with the male thread of the bottle and the cap is rotated, the membrane of the bottle is cut less than 360 degrees to prevent the membrane being cut from detaching from the bottle.

7. A closing and opening device according to claim 6, in which said cutting means is formed inside the second circular wall to extend from the head to a height below the mouth thereof so that when the second female thread is engaged and rotated relative to the male thread of the bottle, the membrane of the bottle is cut circularly less than 360 degrees.

8. A closing and opening device according to claim 7, in which said cutting means is a blade with an upper point, said upper point being located under a plane extending through the mouth of the second circular wall.

9. A closing and opening device according to claim 8, further comprising a cover attached to the second circular wall to close the mouth to thereby prevent materials from entering inside the second circular wall.

10. A closing and opening device according to claim 8, in which said second circular wall includes a slit parallel to the central axis thereof so that liquid deposited inside the second circular wall is exhausted through the slit.

11. A closing and opening device according to claim 8, in which said cutting mean is in the shape of a triangular column having a cutting edge and first, second and third upper corners, the upper point being located on the first upper corner at the cutting edge and extending upwardly higher than the second and third corners and the second corner being located close to a center of the second circular wall so that the membrane cut by the cutting means is pushed toward the center of the opening of the bottle.

* * * * *